United States Patent [19]

Skach, Jr.

[11] Patent Number: 4,500,349

[45] Date of Patent: Feb. 19, 1985

[54] PRODUCTION OF ROUND SALT COATED METAL GRANULES

[75] Inventor: Edward J. Skach, Jr., Angleton, Tex.

[73] Assignee: The Dow Chemical Company, Midland, Mich.

[21] Appl. No.: 518,775

[22] Filed: Jul. 29, 1983

Related U.S. Application Data

[62] Division of Ser. No. 334,201, Dec. 24, 1981, abandoned.

[51] Int. Cl.[3] ..... C22C 1/04

[52] U.S. Cl. ..... 75/0.5 B; 75/67 R; 264/8

[58] Field of Search ..... 264/5, 8, 140, 144, 264/6; 420/402; 75/0.5 B, 0.5 C, 67 R

[56] References Cited

U.S. PATENT DOCUMENTS 2,629,895 3/1953 Miller ..... 264/144
3,812,226 5/1974 Bussy ..... 264/6
4,279,641 7/1981 Skach et al. ..... 264/6

FOREIGN PATENT DOCUMENTS 54-157775 12/1979 Japan ..... 264/140
55-116431 9/1980 Japan ..... 264/140

OTHER PUBLICATIONS

"Buflovak Flaker", Blawknox Co., Catalog 370, 2 pp., Jan. 1964, 264–144.

*Primary Examiner*—James Lowe
*Attorney, Agent, or Firm*—W. J. Lee

[57] ABSTRACT

Molten salt containing molten metal is continuously feed to the top side of a horizontal rotating table. As the table rotates the mixture is cooled to a friable solid which is then scraped from the table. Salt coated metal granules are produced which are round in shape and not elongated.

6 Claims, 3 Drawing Figures

PRODUCTION OF ROUND SALT COATED METAL GRANULES

CROSS-REFERENCE TO RELATED APPLICATION

This is a divisional of application Ser. No. 334,201 filed Dec. 24, 1981 now abandoned.

BACKGROUND OF THE INVENTION

Preparations of Mg or Mg alloy granules in a friable salt matrix are taught, e.g., in U.S. Pat. No. 4,186,000; U.S. Pat. No. 4,182,498 and U.S. Pat. No. 4,279,641. In those patents there are taught methods in which molten mixtures of Mg (or Mg alloy) and salts are processed in a manner such that when the melts are cooled to the point of being frozen, the Mg is in dispersed form within the salt mixture. It is also disclosed there that the friable salt matrix is broken up in a manner such that the round granules of Mg are freed from entrapment in the salt matrix for removal from the salt, except that there remains on each granule a tightly-bound protective salt layer.

In U.S. Pat No. 4,186,000 and U.S. 4,279,641 (incorporated herein by reference) there is disclosed the freezing of the molten mixture of Mg and salts by the technique of pouring the melt onto a revolving chilled roller on a flaking machine where the melt freezes as a thin sheet and is broken up into flakes by the action of the scraper blade. It has been found that in some melts, there is a tendency for some of the molten Mg particles to "stretch" into elongated particles due to the gravity flow (slippage) down the roller surface before the Mg becomes frozen. Then when the Mg freezes, the elongated (sometimes "stringy") shape is retained by the frozen Mg; this is not a welcome result when it is desired that the Mg granules be round, or at least nearly round in shape.

In order to provide a chilled surface on which the molten mixture could be cooled on a continuous feed basis, while avoiding the adverse effects of gravity encountered by the sliding of the melt down the non-horizontal surface of a chilled roll, the present novel rotary table flaker was designed. This novel rotary cooling table (also called a rotary table flaker) may also be used for chilling other melts on a horizontal, moving surface from which they are scrapped by a blade after being appropriately chilled.

SUMMARY OF THE INVENTION

A flat, planar, horizontal, circular, rotatably mounted sheet or plate, in operable combination with a fixated rotation means, a cooling means, a feed means for feeding a molten material to the surface as it rotates, and a means for scraping said material from the surface at a point distal from said feed means is employed in a process wherein a molten material is fed to the rotating plate, is cooled to remove heat from the fed material, and the cooled material is scraped from the plate before the material can rotate to the point at which the molten material is fed to the rotating plate. The speed of rotation is less than that which would cause movement of the material across the surface of the plate by centrifugal action.

DETAILED DESCRIPTION OF THE INVENTION

Figure 1:
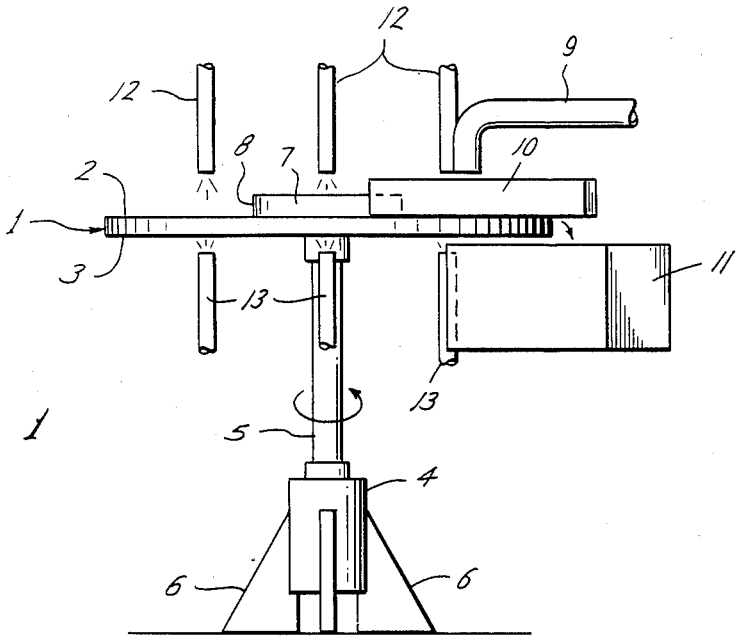
Figure 2:
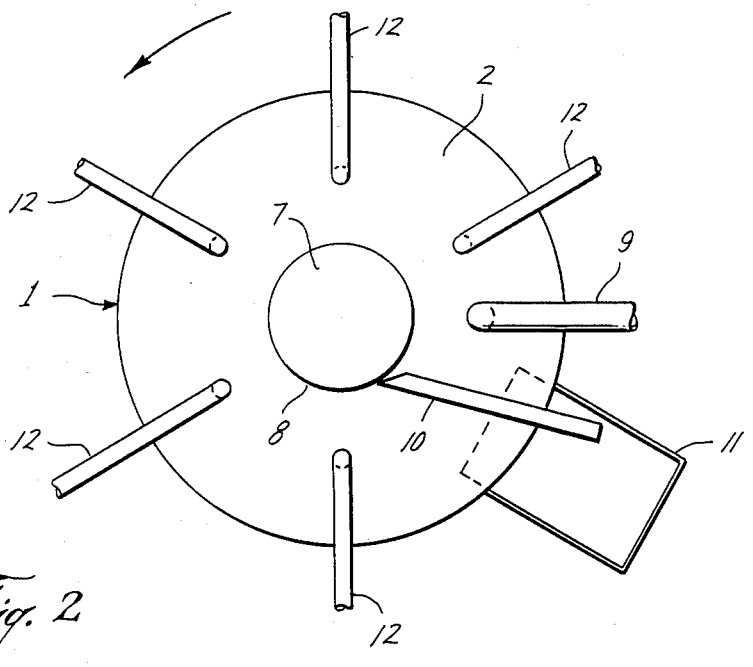
Figure 3:
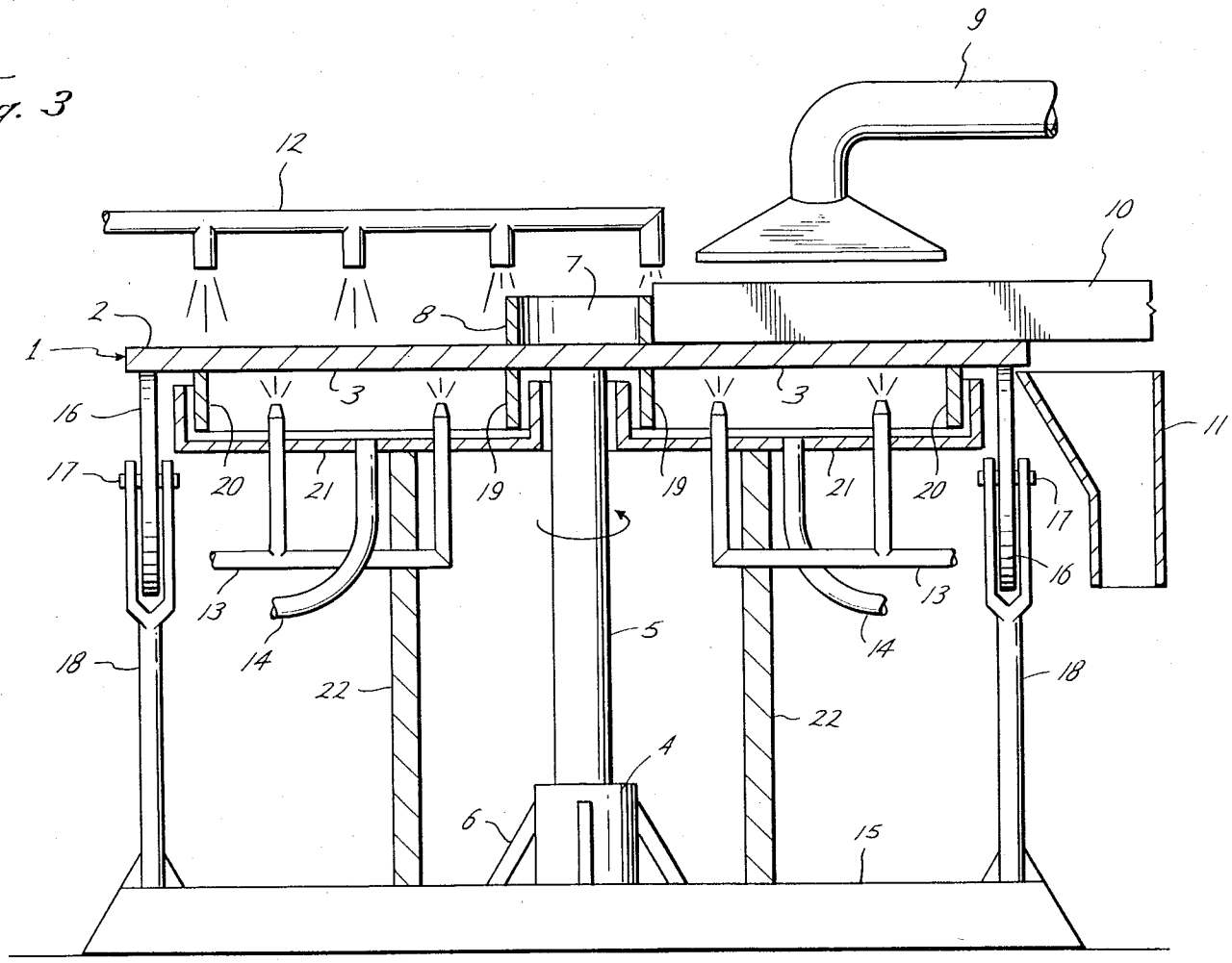

FIGS. 1, 2, and 3 are graphic representations of various embodiments to serve as visual aids in describing the process and apparatus of the present invention.

FIG. 1 is a schematic elevation to illustrate a revolvable table surface or plate (1) having a top planar surface (2) and a bottom surface (3). The plate (1) is rotated by support means (5) by the operation of rotation means (4). Rotation means (4) is fixed in place by supports (6). Concentrically mounted in the center of plate (1) is a raised circular portion (7) which provides a vertical, concentric surface (8). Molten material is fed to surface (2) of plate (1) by feed means (9) as a relatively thin sheet. The molten material becomes cooled before it reaches scraper blade (10) and is scraped off into a material receptacle (11). Cooling means (12) and/or (13) are employed as needed to remove heat and cool the material before it reaches the scraper (10) which is closely positioned near or against surfaces (2) and (8). The feed means (9) may be oscillated, by means not shown, to lay down a serpentine ribbon on the revolving plate; the speed of the oscillation can be regulated or programmed to lay down a substantially constant thickness. Attachments and supports for cooling means (12) and (13), for feed means (9), for scraper (10), and for receptacle (11) are not shown for purposes of conciseness, but it is easily understood that such supports and attachments can be made adjustable. For instance, the scrapper (10) may be adjusted to various distances from feed means (9), or feed means (9) may be adjusted to various distances from scraper (10) as desired. Also, the rotational speed of plate (1), the cooling rate provided by the cooling means, and/or the rate of flow of the feed material through feed means (9) can be adjusted by amounts commensurate with the desired results. It will be realized that the rotational speed of the plate should be low enough to prevent centrifugal forces from causing flow of material toward the edge of the plate before it reaches the scraper blade.

FIG. 2 is a schematic top-view to illustrate counterclockwise rotation of plate (1), the feeding of molten material through feed means (9), the cooling through use of cooling means (12) and the operation of scraper (10) against surfaces (2) and (8) which scrapes the material into receptacle (11). Obviously, the apparatus can be designed to run clockwise, if desired.

FIG. 3 represents a side-view, not to scale, where the cross-hatching represents cross-sectional views of some of the parts. Plate (1) is shown as having a top surface (2) and a bottom surface (3). Plate (1) communicates by way of shaft (5) to rotation means (4) which is fixated to base (15) by support or attachment means (6). Feed means (9) illustrates a slotted feed means instead of a circular feed means; this slotted feed means can lay down a relatively thin layer of the molten material, the thickness of the layer being adjustable by varying the flow rate of the feed, by adjusting the width of the feed slot, and/or by adjusting the speed of rotation of plate (1). Scraper (10) operates against surfaces (8) and (2) to scrape the cooled material into receptacle (11). The material in receptacle (11) may be conveyed, by means not shown, to storage or futher processing such as by using a conveyor or to a grinder and then to a conveyor.

When quite large, heavy metal plates are used, especially where very high temperatures are employed, it is often advisable to employ liquid coolants to the bottom side (3) of plate (1) to obtain the desired heat transfer from the metal plate. One embodiment which is beneficial in providing such cooling is as shown in FIG. 3, where two concentric vertical walls descend from surface (3), wall (19) being relatively near the center of plate (1) and wall (20) being relatively near the outer edge of plate (1). The portion of surface (3) which is bounded by walls (19) and (20) may be sprayed by nozzles of cooling means (13) which protrude through a fixated pan (21). The pan (21) is provided with an inner vertical circular wall extending upwardly to lie close to revolving wall (19) and an outer vertical circular wall to lie close to, and on the outside of, revolving wall (20). The pan (21) is equipped with drain means (14) to carry away the cooling liquid which falls from surfaces (3). Support members (22) hold pan (21) in place.

Also, with reference to FIG. 3, when a large heavy metal plate (1) is used especially at high temperature, it is advisable to employ supplemental support means to help avoid sagging or warping of the plate. This supplemental support may be provided, as illustrated, by employing support rollers (16) which revolve on spindles or axles (17) in support members (18) which are fastened to a base (15). Several such rollers may be used, though only two are shown in FIG. 3.

In FIG. 3, cooling means (12) is shown as a conduit having a plurality of nozzles or openings to direct cooling gas to the material on plate (1), but the precise arrangement shown is not the only arrangement which may be used. The cooling gas may, in some cases, be air or may be an inert gas such as nitrogen, helium, carbon dioxide, etc. Whether or not the cooling gas is adversely reactive with the material to be cooled is dependent on the material.

The molten material which may be fed to the rotating plate may be of heterogenous or homogenous composition, so long as it is substantially friable, plastic, or brittle when cooled so that the scraper can cause the material to be scraped from the plate. Of particular interest is a molten salt composition, especially one which contains small particles of metal dispersed therein, and which, when frozen, comprises a heterogenous, but brittle, mixture of frozen metal particles entrapped in a frozen, friable salt matrix. The following example illustrates an embodiment of the present process, but the present concept is not limited to the specific example shown.

EXAMPLE 1

A molten mixture comprising about 40% by weight of molten magnesium dispersed as small particles in a molten matrix of salt (i.e., a mixture of predominantly alkali metal halide, alkaline earth metal halide and a small amount of metal oxides) is fed to a non-central portion of the top side of a flat, horizontal, rotating, circular steel plate. The manner of feeding the molten material causes it to lay down on the plate as a relatively thin layer. As the plate revolves, the material is cooled to a solid by cooling means to remove heat from the material. By the time the rotating material reaches a scraper, it is in the form of a brittle, friable solid, and the scraper causes it to break into flakes or fragments of irregular size and shape and fall from the plate into a receptacle.

The illustrations and embodiments disclosed herein are representative, and variations therefrom may be made without departing from the present novel concepts.

I claim:

1. A process which consists essentially of feeding a molten salt material, having small metal particles dispersed therein, to a non-central portion of the top side of a flat, planar, horizontal, circular, rotating sheet or plate, maintaining the material in a substantially dry or inert atmosphere while cooling the material on said sheet or plate to a state at which it is brittle, friable, or plastic, and scraping the cooled material from the rotating sheet or plate before it reaches the point at which it was fed to the plate, said rotating being done at a speed which is less than that which would cause movement of the material across the surface of the plate by centrifugal action.

2. The process of claim 1 wherein the molten material comprises a molten salt composition having small particles of magnesium or magnesium alloy dispersed therein.

3. The process of claim 1 wherein the molten material comprises a mixture of magnesium particles and salt, wherein the salt comprises a predominant amount of alkali metal halide, alkaline earth metal halide, and a small amount of metal oxides.

4. A process for freezing a molten material comprised of molten salt having small metal particles dispersed therein, and collecting the frozen material as fragments, said process comprising maintaining the material in a substantially dry or inert atmosphere while feeding the molten material to a non-central portion of the top side of a flat, planar, horizontal, circular sheet or plate, and while cooling said material to below its freezing temperature on said sheet or plate, and scraping the frozen material in fragmented form from the rotating sheet or plate before the material reaches the point at which it was fed to the sheet or plate, said rotating being done at a speed which is less than that which would cause movement of the material across the surface of the plate by centrifugal action.

5. The process of claim 4 wherein the molten material comprises a salt composition having small particles of magnesium or magnesium alloy dispersed therein.

6. The process of claim 4 wherein the molten material comprises a mixture of magnesium or magnesium alloy particles and salt, wherein the salt comprises a predominant amount of alkali metal halide, alkaline earth metal halide, and a small amount of metal oxides.

* * * * *